US007037205B1

(12) United States Patent
Bowman

(10) Patent No.: US 7,037,205 B1
(45) Date of Patent: May 2, 2006

(54) BABY CARRIER HAVING AN INTEGRAL SWINGING MECHANISM

(76) Inventor: Jeffrey Alan Bowman, 205 Sagebrush Ct., Georgetown, TX (US) 78628

( * ) Notice: Subject to any disclaimer, the term of this patent is extended or adjusted under 35 U.S.C. 154(b) by 47 days.

(21) Appl. No.: 10/931,691

(22) Filed: Sep. 1, 2004

(51) Int. Cl.
*A63G 9/12* (2006.01)

(52) U.S. Cl. ..... 472/118; 472/119; 297/183.1

(58) Field of Classification Search ..... 472/118–125; 297/16.1, 16.2, 17, 129, 118, 183.1, 183.2, 297/183; 5/108, 109
See application file for complete search history.

(56) References Cited

U.S. PATENT DOCUMENTS

| | | | | |
|---|---|---|---|---|
| 3,022,520 | A | 2/1962 | Finger | |
| 3,225,365 | A | 12/1965 | Miller et al. | |
| 3,453,999 | A | 7/1969 | Neal | |
| 3,515,418 | A | 6/1970 | Nielsen, Jr. | |
| 3,653,080 | A | 4/1972 | Hafele | |
| 3,851,343 | A | 12/1974 | Kinslow, Jr. | |
| 4,598,946 | A | 7/1986 | Cone | |
| 4,634,175 | A * | 1/1987 | Wise | 297/183.3 |
| 4,656,680 | A | 4/1987 | Wilson | |
| 4,688,850 | A | 8/1987 | Brownlie et al. | |
| 4,985,949 | A | 1/1991 | Jantz | |
| 5,143,419 | A | 9/1992 | Tepper et al. | |
| 5,244,292 | A | 9/1993 | Wise | |
| 5,265,932 | A | 11/1993 | Leonard | |
| 5,277,472 | A | 1/1994 | Freese et al. | |
| 5,322,343 | A | 6/1994 | Parker et al. | |
| 5,522,639 | A | 6/1996 | Jaime | |
| 5,681,082 | A | 10/1997 | Drexler | |
| 5,803,817 | A | 9/1998 | Stern | |
| 5,860,698 | A | 1/1999 | Asenstorfer et al. | |
| 5,961,180 | A | 10/1999 | Greger et al. | |
| 6,145,927 | A * | 11/2000 | Lo | 297/250.1 |
| 6,149,489 | A * | 11/2000 | Johnson | 446/227 |
| 6,378,940 | B1 | 4/2002 | Longoria et al. | |
| 6,431,646 | B1 | 8/2002 | Longoria | |

* cited by examiner

*Primary Examiner*—Kien Nguyen
(74) *Attorney, Agent, or Firm*—Gerald E. Moy

(57) ABSTRACT

An improved baby carrier device having an integral swinging mechanism which is capable of providing a pendulum-like rocking action thereto is herein disclosed. In addition to other known uses such as a containment mechanism for infants or as a receptacle for mounting within a baby carriage, or car seat, the present invention enhances the utility of a conventional baby carrier system via the incorporation of a integral baby swing, thereby abating the need for other extraneous mechanisms or other related swing drive devices. The carrier device has a pair of leg assemblies which are incorporated into the handle assembly thereof and are selectively adjustable by a user from an extended position wherein said carrier shell is suspended above a support surface in a stable manner, to a retracted position wherein the leg assemblies are confined within the housing of the handle assembly. Self-propelled actuation means are also described which drivingly couples the rotational force of a motor drive means to the reciprocal pendulum-like action of the swing assembly.

19 Claims, 7 Drawing Sheets

BABY CARRIER HAVING AN INTEGRAL SWINGING MECHANISM

CROSS-REFERENCE TO RELATED APPLICATIONS

Not applicable.

FIELD OF THE INVENTION

This invention generally relates to to baby carrier devices, and more particularly, to an improved baby carrier device having a swinging mechanism integrally incorporated therein for imparting a self-propelled pendulum-like swinging action thereby providing a soothing and calming effect for an infant positioned therein.

BACKGROUND OF THE INVENTION

Baby carriers, bassinets, cribs, baby carriages, baby swings, and baby car seats comprise a list of baby holding devices that are used to contain an infant for various assundry purposes including the sleep, containment, or transport thereof. More recently, baby holding devices having multiple uses have gained significant consumer acceptance due to the relatively lower initial cost outlay in addition to the increased functionality provided thereby. Thus, a conventional baby carrier having specific utility as a means for transporting an infant while walking may also be configured for use as a car seat, or even as a receptacle for mounting within a baby carriage, thereby creating a baby carrier system. Additionally, the conventional baby carrier system has also found viable utility as a portable rocker via the implementation of convex shaped support surfaces fashioned therebeneath, which allow the baby carrier to be manually rocked to-and-fro by an accompanying adult.

It is well known that imparting a reciprocating or rocking motion to a young infant has a calming as well as a sleep inducing effect thereon. Due to this fact, many attempts have been made to incorporate a swinging mechanism into various types of baby holding devices. One such type of baby holding device includes a baby crib having reciprocating means as described by U.S. Pat. No. 3,022,520 to Finger, and U.S. Pat. No. 3,225,365 to Miller et al. Nevertheless, smaller, more portable devices such as those described by U.S. Pat. No. 3,653,080 to Hafele, U.S. Pat. No. 3,851,343 to Kinslow and U.S. Pat. No. 6,378,940 to Longoria. et al. have been developed which utilize a reciprocatingly enabled baby recliner device. Although the '080, '343, and '940 devices are all relatively more portable than the crib type devices denoted hereinabove, their designs suffer in that they are dedicated to the single utilitarian function of rocking a baby. That is, neither of these devices is configurable for use as a baby carrier, or as a receptacle for mounting in a car seat or a baby carriage.

In order to extend the functionality of the conventional multi-use baby carrier system for use as a self-propelled swing or rocker, motorized actuating mechanisms have been developed which cause the conventional baby carrier to rock to-and-fro when placed on a large flat surface such as a floor wherein several examples of such devices includes U.S. Pat. No. 4,985,698 to Jantz, and U.S. Pat. No. 5,860,698 to Asenstorfer, et al. Although both of these devices do provide utility as a self-propelled motion imparting device for the baby carrier, they both exist as external mechanisms to the baby carrier system and thus possess the inherent drawback of an extraneous part which may possibly become inadvertently displaced from the baby carrier device, thus negating their usefulness for their intended purpose. Additionally, the motorized rocking system described by the aforementioned devices would find very limited use on uneven or soft surfaces such as lawns, which is a typical surfacing feature found at parks, front yards, golf courses, and the like.

There has thus been a long-felt need for baby carrier system having the ability to impart a self-propelled swinging or rocking motion for the purpose of comforting and calming of a baby disposed thereinside. The self-propelled actuating mechanism should optimally exist as an integral portion of the baby carrier device and should be easily configurable for use either as a baby carrier or as a baby swing.

SUMMARY OF THE INVENTION AND OBJECTIVES

The present invention provides a solution to these needs as well as other needs via an integral reciprocating mechanism for a baby carrier seat which imparts a self-propelled swinging action thereto in order to calm and relax an infant seated therein. The swinging mechanism of the present invention exists as an integral portion of the baby carrier thereby enabling the convenient use thereof as a baby swing at virtually any location. Thus, the utility of a conventional baby carrier system is enhanced to provide functionality of a baby swing in addition to other uses such as a car seat or as a receptacle for mounting within a baby carriage, thereby abating the need for extraneous mechanisms or other related swing drive devices. Moreover, the baby carrier seat in conjunction with the novel swinging mechanism of the present invention is selectively configurable for use either as a baby carrier or as a baby swing thus negating the need for cumbersome externally configured swing drive mechanisms.

It is therefore a primary object of the present invention to provide an improved baby carrier having an integral swinging mechanism which is capable of imparting a swinging action to a baby carrier device.

A further object of the present invention is to provide an integral reciprocating mechanism for a baby carrier seat which exists as an integral portion of a conventional baby carrier seat, wherein the utility thereof is enhanced in order to provide a self-propelled swinging action thereto.

Another further object of the present invention is to provide a reciprocating mechanism for a baby carrier which exists as an integral portion of a conventional baby carrier seat which is easily portable and is capable of being used at any location where a parent may carry their infant.

Another object of the present invention is to provide a novel reciprocating mechanism which is configurable to swing a baby carrier seat in a pendulum type motion, wherein said pendulum type motion causes the combination of said baby carrier and seated infant to swing at the resonant frequency thereof, thereby imparting a smooth, soothing ride for said infant.

Another object of the present invention is to provide an integral reciprocating mechanism for a baby carrier seat which is relatively low cost, compact, and easy to use.

These and other objects of the present invention will become readily apparent to those familiar with the construction and use of baby holding devices and will become apparent in the following portions of the specification, wherein the detailed description is for the purpose of fully disclosing preferred embodiments of the invention without placing limitations thereon.

BRIEF DESCRIPTION OF THE DRAWINGS

For a further understanding of the nature and objects of the present invention, reference should be made to the following detailed description, taken in conjunction with the accompanying drawings, in which like elements are given the same or analogous reference numbers, and wherein.

DETAILED DESCRIPTION OF THE PREFERRED EMBODIMENTS

Figure 1:
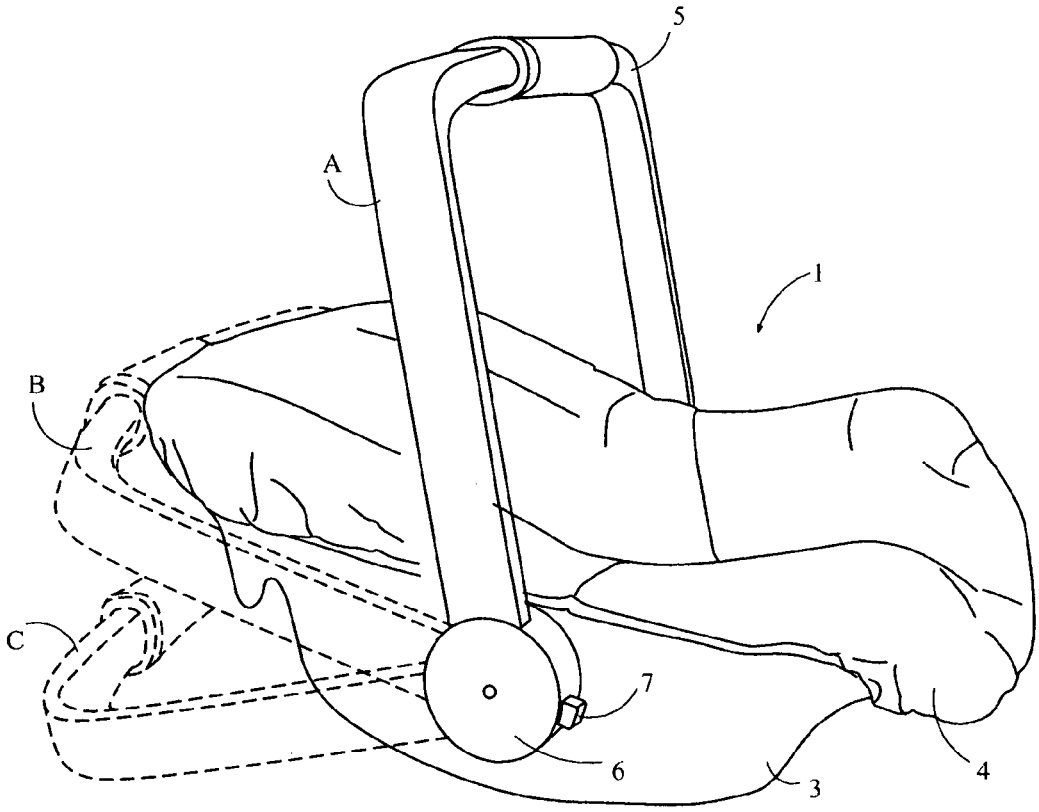
PRIOR ART FIG. 1
FIG. 1 is a perspective view of a prior art baby carrier device, wherein alternative angular positions of the handle assembly relative to the carrier seat are shown in dashed lines.

Referring now to the drawings, and in particular to FIGS. 1 through 13 thereof, a new and improved baby carrier having an integral swinging mechanism embodying the principles and concepts of the present invention and generally designated by the reference numeral 10, will now be described.

As illustrated in FIG. 1, a prior art baby carrier 1 is shown which may exist as a stand-alone device for the containment and transport of an infant or more preferably may exist as a portion of a baby carrier system wherein the baby carrier 1 may also be utilized as a receptacle for releasably mounting within a baby carriage assembly (not shown) or a car seat mount (not shown). The baby carrier 1 has an infant carrier shell 3 for containment of an infant therein having a fabric inlay 4 to provide a cushioning as well as a thermally insulating effect for the infant positioned therein. The prior art baby carrier 1 also has a handle assembly 5 for lifting and transport of the baby carrier 1 by an accompanying adult which is typically formed of rigid material into a generally inverted U-shape having hub assemblies 6 attached at both depending ends thereof. Although only the left side hub assembly is shown in the drawings for clarity, it is to be understood that the right side hub assembly is a mirror image thereof. The hub assemblies 6 interconnect the handle assembly 5 to the infant carrier shell 3 via a rotatable connection and release buttons 7 configured in either hub assembly 6 enable the handle assembly to be locked in a plurality of angular positions relative to the carrier shell 3. Thus, the handle assembly 5 may be held at angular orientation "A" for lifting and transport of the baby carrier 1, which is denoted as the transport position. Alternatively, if access to the infant is desired or if the carrier 1 is to be releasably mounted within the baby carriage assembly or car seat mount, the release buttons 7 may be depressed thereby allowing the handle assembly to be rotated to angular orientation "B", otherwise denoted as the access position. Other optional angular orientations include orientation "C" which allows the carrier shell 3 to be propped-up thereby placing the infant in a seat-forward position when placed on a flat surface such as a floor.

Figure 2:
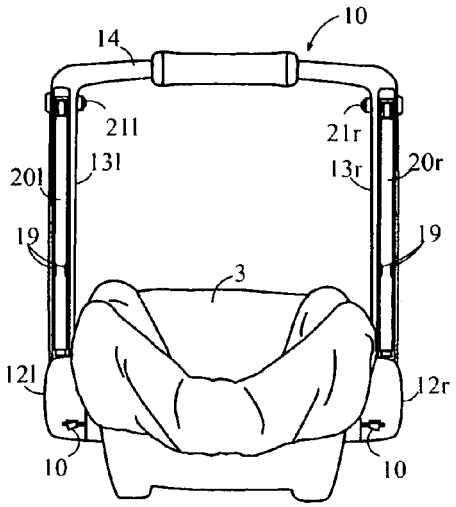
FIG. 2 is a front elevational view of the present invention shown with the legs thereof in the retracted position.
Figure 3:
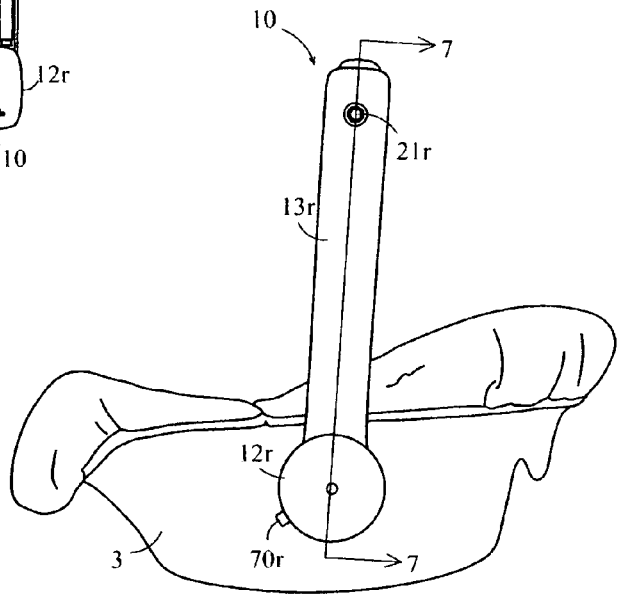
FIG. 3 is a right side elevational view of the present invention shown with the legs in the retracted position.
Figure 4:
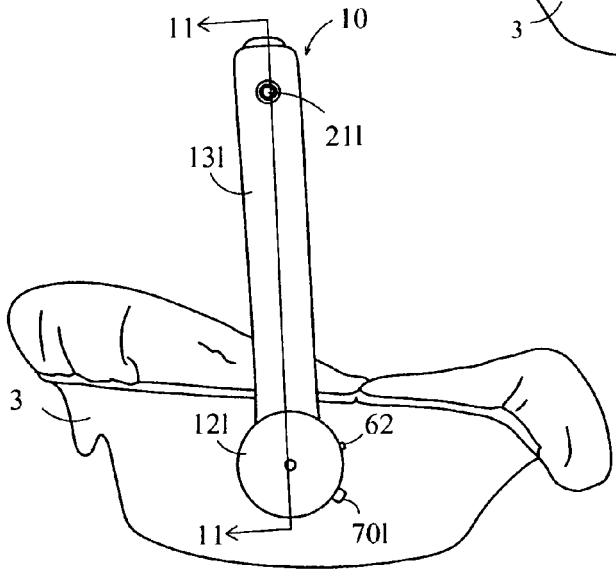
FIG. 4 is a left side elevational view of the present invention shown with the legs in the retracted position.
Figure 5:
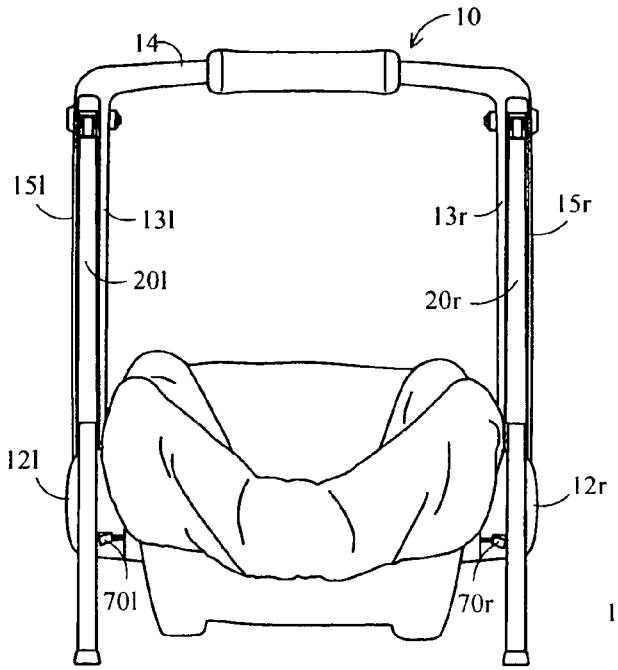
FIG. 5 is a front elevational view of the present invention shown with the legs thereof in the extended position.
Figure 6:
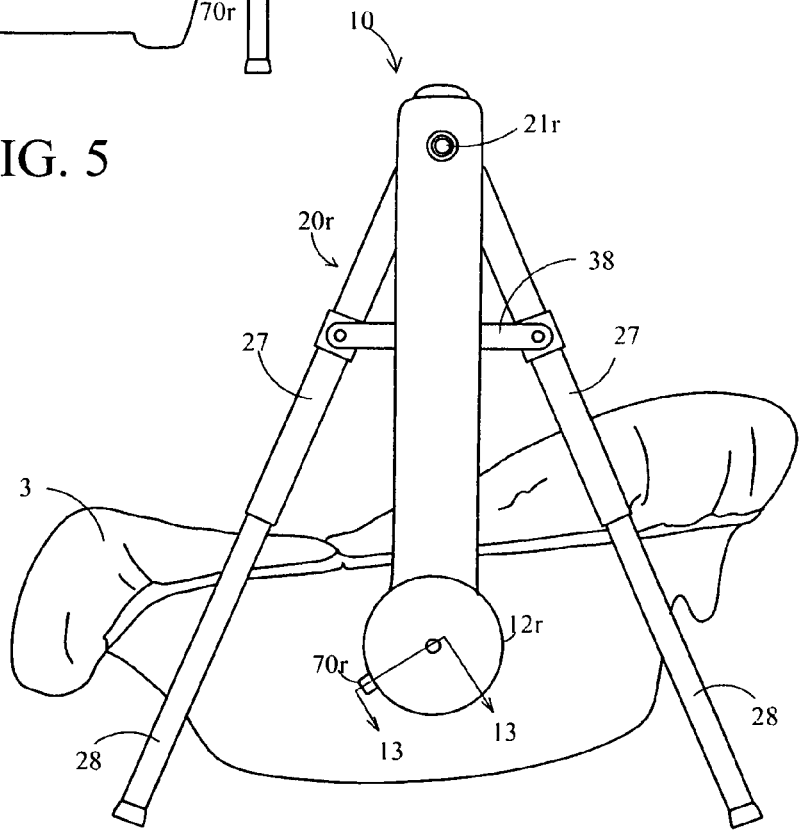
FIG. 6 is a right side elevational view of the present invention shown with the legs in the extended position.
Figure 7:
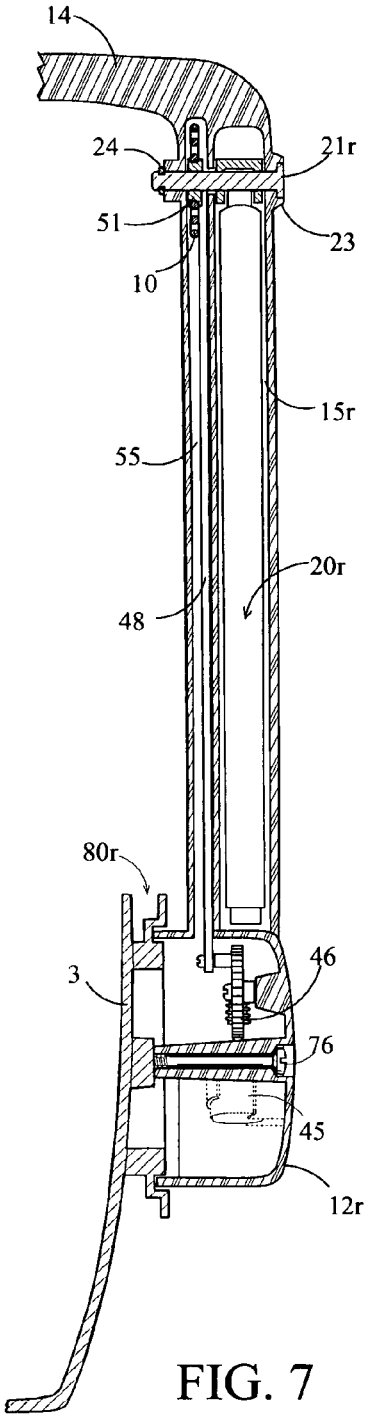
FIG. 7 is a cut-away view taken at 7—7 of FIG. 3, showing the arrangement of components of the drive assembly in the right vertically extending portion of the handle assembly.

The present invention enhances the utility of the aforedescribed prior art baby carrier 1 by incorporating a handle assembly 10 having a swing mechanism integrally formed therein which is selectively configurable to allow the carrier shell to be swung in a pendulum fashion thus providing a soothing and relaxing experience to an infant seated therein as shown in FIGS. 2 through 13. FIGS. 2 through 4 depicts a baby carrier device having the enhanced handle assembly 10 of the present invention configured thereon shown with a pair of leg assemblies (20*l* and 20*r*) integrally attached to the handle assembly shown in the retracted position. Thus while in the retracted position, the baby carrier may be used in any of the aforedescribed modes such as a stand-alone device or as a portion of a baby carrier system in a manner similar to the prior art type baby carrier of FIG. 1. Additionally, the enhanced handle assembly 10 of the present invention has sliding release buttons (70*l* and 70*r*) which allows the handle assembly to be selectively disposed at a plurality of angular orientations relative to the carrier shell 3 thereof in a similar manner to the prior art baby carrier device 1. Conversely, when the leg assemblies (20*l* and 20*r*) are selectively moved to the extended position as shown in FIGS. 5 through 7, the baby carrier device is enabled for use as a swing.

The handle assembly 10 of the present invention generally comprises an inverted generally U-shaped rigid member having left 12*l* and right 12*r* hub assemblies integrally attached at the depending ends and a cross member 14 interconnecting the upper ends thereof. Both vertically extending portions (13*l* and 13*r*) of U-shaped member have swing support structure means comprising leg assemblies (20*l* and 20*r*) configured therein which are reciprocatively movable from the retracted to the extended position by an adult user. As shown more concisely in FIGS. 7, 9, and 11, a pair of elongated through holes (15*l* and 15*r*), the longitudinal extent thereof which is substantially co-linear with the longitudinal extent of their respective vertically extending portions (13*l* and 13*r*), are integrally formed therein and each are dimensioned to accept its respective leg assembly (20*l* and 20*r*) therein. Leg retention means defined by projections 19 existing on the forward and aft sections of the vertically extending portions and are integrally formed therewith and project inwardly into each of the through holes (15*l* and 15*r*) in order to releasably secure all of the legs therewithin while in the retracted position. The right and left (20*l* and 20*r*) leg assemblies are rotatably interconnected to the vertically extending portions proximate the upper end thereof via spindles (21*l* and 21*r*) formed preferably of metal, which serve to act as a fulcrum mechanism for the pendulum swinging action of the carrier shell 3. The spindles (21*l* and 21*r*) extend through bearings 23 which are integrally formed on the upper portion of each of the vertically extending portions (13*l* and 13*r*) and are held in place via snap rings 24 that are adapted to be springably biased into annular slots 22 formed on the spindles.

Figure 9:
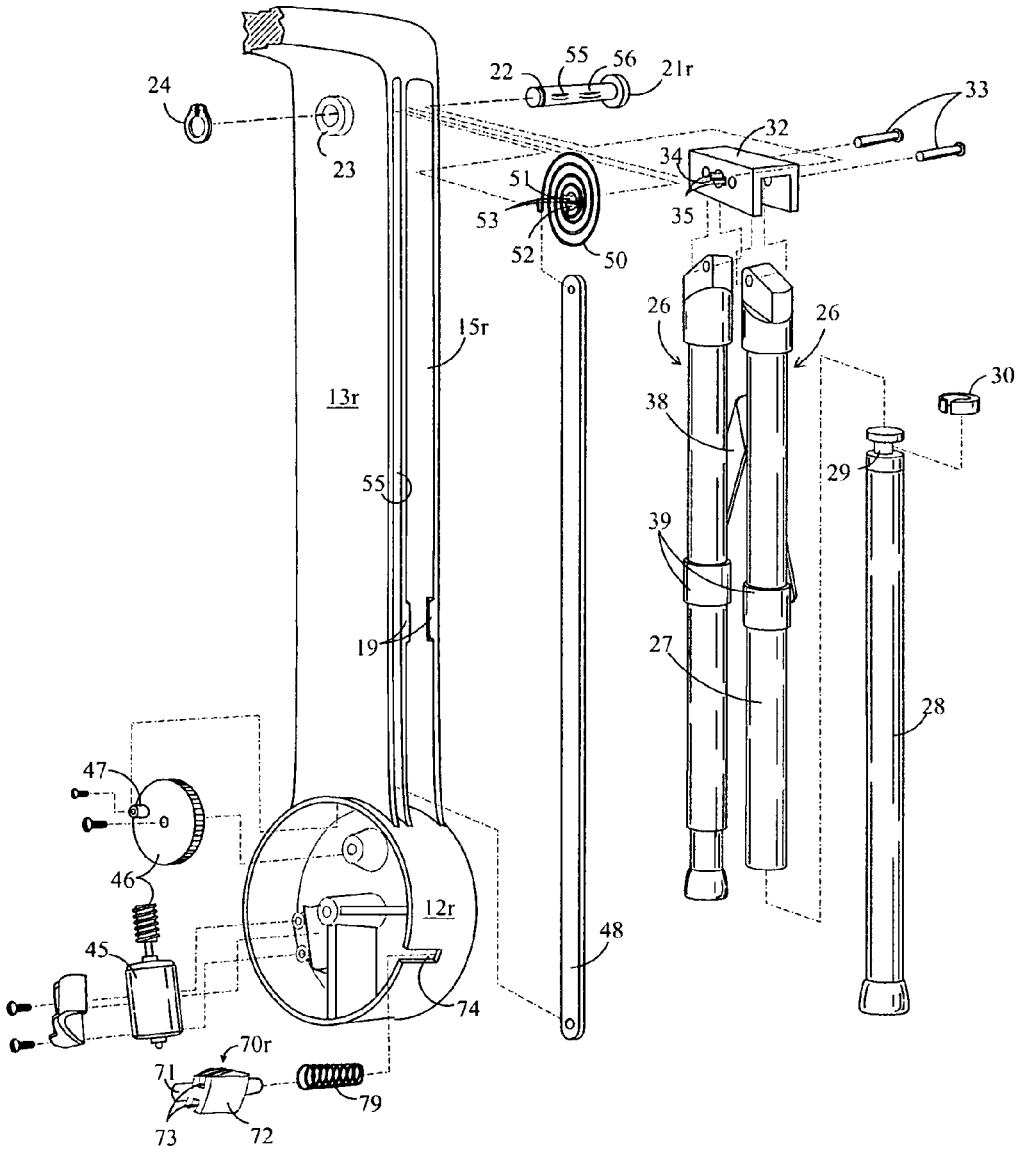
FIG. 9 is a perspective exploded view of the right vertically extending portion of the handle assembly in order to reveal the various components of the drive assembly.

The left 20*l* and right 20*r* leg assemblies are essentially symmetrically similar in design so only the right 20*r* leg assembly will be described. As best shown in FIG. 9, the right leg assembly 20*r* comprises two extendable legs 26 that are interconnected to a generally U-shaped member 32 formed preferably of metal, via metallic pins 33 which are secured thereinto via a press fit. Both depending ledges of member 32 have holes 34 in conjunction with two opposing integrally formed slots 35 for insertion of spindle 21*r* therethrough for the purpose of which will be described hereinbelow. Each of the legs 26 includes an upper section 27 defining a hollow circular cross-section and a lower section 28 having a circular cross-sectional size sufficient to provide for slidable insertion into the inner cavity of said upper section 27. Although there are numerous well known mechanisms that provide for selective adjustment of the effective length of each of the legs, the preferred mechanism for releasably interlocking the lower section 28 to the upper section 27 incorporates an eccentrically disposed cam member 29 having a locking ring 30 encircled thereabout, wherein said locking mechanism as described in U.S. Pat. No. 3,515,418, to Nielsen, issued Jun. 2, 1970, is hereby incorporated by reference. Nevertheless, structural stability for each of the leg assemblies are provided by an optional hinged cross-brace 38 which is attached to each of the legs via collars 39. The collars 39 may be attached to the outer surface of the legs 26 using any suitable means such as weldment, or the like.

Figure 8:
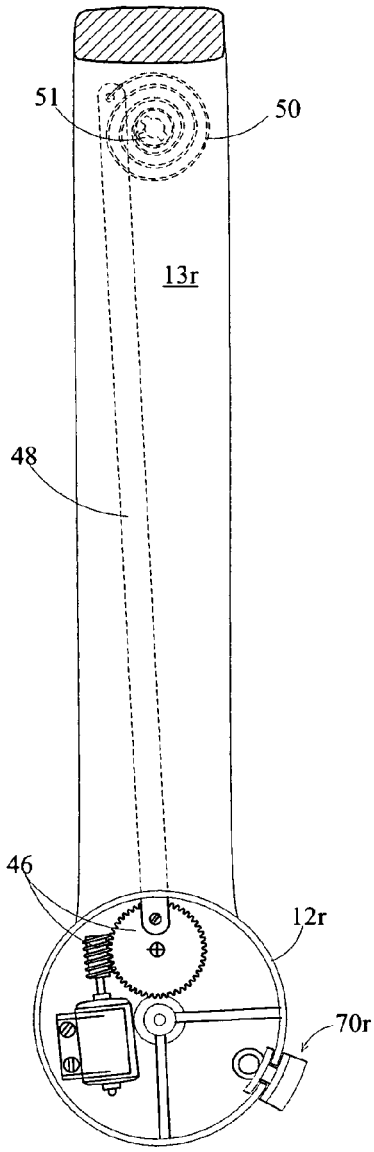
FIG. 8 is an inside elevational view of the right side of the handle assembly of the present invention shown removed from the carrier seat. The figures in dashed lines reveal the portions of the drive assembly which are disposed within the cavity.

Self-propelled actuation of the swinging mechanism of the present invention is provided by a swing drive assembly mounted in the right vertically extending portion 13*r* of the handle assembly as best shown in FIGS. 7, 8, and 9. The swing drive assembly generally comprises an electric DC motor 45, a worm gear assembly 46 coupled to the output shaft thereof, and a pushrod 48 which translates the rotational motion of the worm gear assembly 46 to a to-and-fro reciprocal action of a torque spring 50. Although the present embodiment describes the use of an electric motor as a motor drive means, it is well known in the art that alternative motor drive means such as a manual wind-up spring drive means would be a valid substitute. In addition to providing a means of rotational speed reduction, the worm gear assembly also has a post 47 eccentrically attached thereto for providing a rotatable connection of the depending end of the pushrod 48. The pushrod 48 as well as the torque spring 50 are disposed within an elongated cavity 55 which is formed in the vertically extending portion 13*r* of the handle assembly and extends substantially co-planar to through hole 15*r*. The cavity 55 extends into the inner cavity portion of hub assembly 12*r* thereby allowing the pushrod 48 to extend from the post 47 to the torque spring 50.

The torque spring 50 acts as a lever which translates the generally linear to-and-fro motion of the upper end of the pushrod 48 to a reciprocal rotational motion of the spindle 21*r*. The torque spring 50 is maintained in torsional communication with spindle 21*r* via a spring hub 51 which has a through hole 52 in conjunction with two opposing slots 53 integrally formed proximate the central portion thereof for insertion of the spindle 21*r* therethrough. Splines 55 integrally formed on the spindle 21*r* are adapted to engage within the slots 53 upon insertion thereto thereby causing rotational motion of the hub 51 to be imparted to the spindle 21*r* as well. Similarly, another pair of splines 56 integrally formed on the spindle 21*r* are adapted to be engaged into slots 35 formed U-shaped member 32 thereby causing rotational motion of the spindle to be imparted thereto. Thus, rotational motion of the motor 45 is translated to a reciprocal to-and-fro motion of the U-shaped member 32 which causes the carrier shell to swing accordingly. The purpose of the torque spring 50 is to dampen the effect of inconsistencies between the effective reciprocal frequency of the to-and-fro movement of the pushrod 48 with the natural resonant frequency of the carrier shell 3 as well as to protect the components of the swing drive assembly from damage should the carrier shell 3 be forced to an immovable state during the operation thereof. Nevertheless, it is to be noted that although the lever portion of the swing drive assembly as described comprises a torque spring in order to provide dampening therefor, other components of the swing drive assembly may alternatively incorporate spring dampening means such as a pushrod formed of a resilient material and shaped in such a manner to allow a spring-like elongation or contraction thereof. Optionally, electronic circuitry (not shown) may be provided that senses the angular position of the carrier shell 3 relative to the leg assembly 20*r* in order to control power to the motor 45 such that the action of the swing drive assembly is synchronized with the natural resonant frequency of the carrier shell 3.

Figure 10:
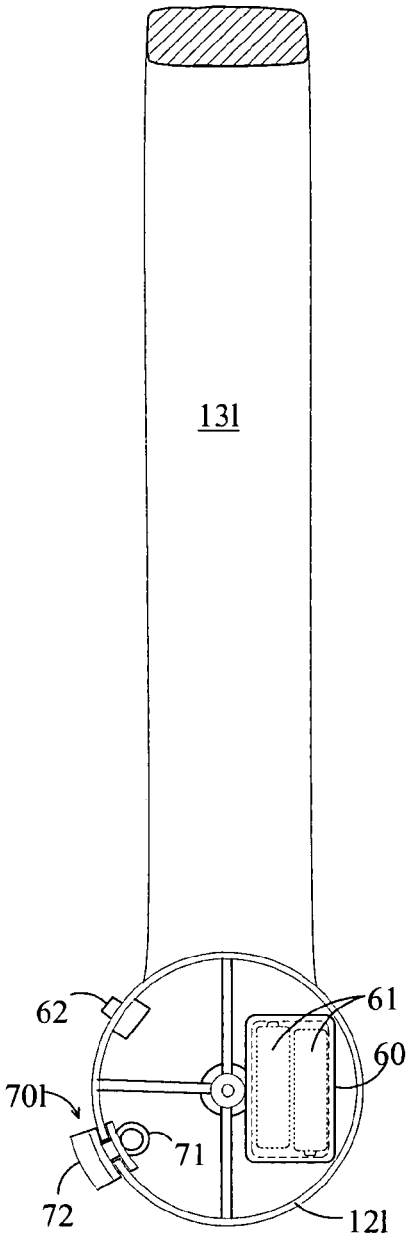
FIG. 10 is an inside elevational view of the left side vertically extending portion of the handle assembly shown removed from the carrier seat.
Figure 11:
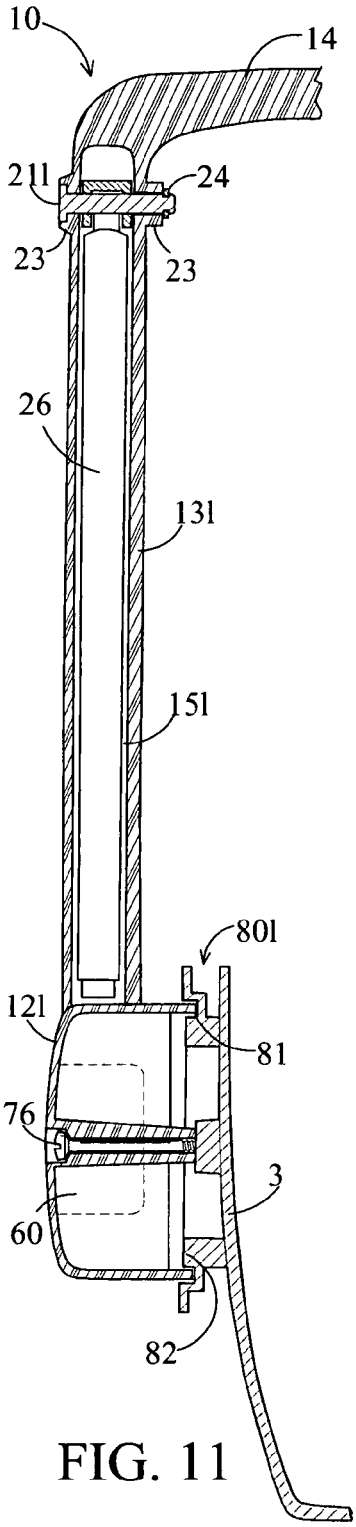
FIG. 11 is a cut-away view taken at 11—11 of FIG. 4 showing the arrangement of the battery compartment within the left side hub assembly.
Figure 12:
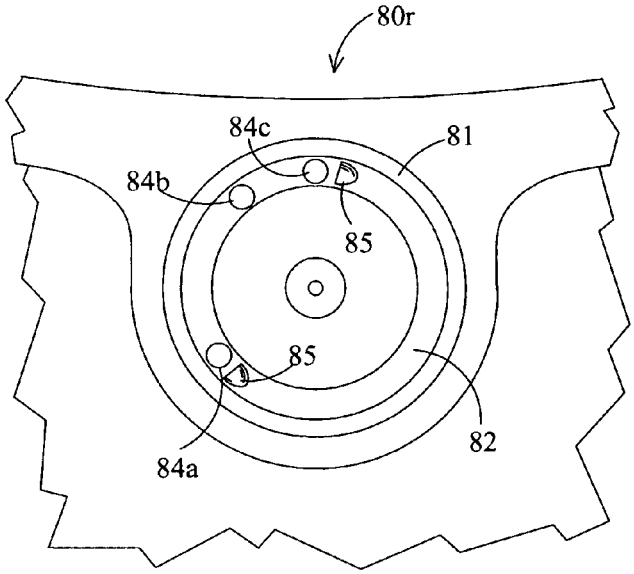
FIG. 12 is a partial side elevational view of the carrier seat showing the configuration of the right side hub seat.

Electrical power to drive the electric motor 45 is supplied by replaceable batteries 61 which are contained in an onboard battery compartment 60 located in the left side hub assembly 20*l* as best shown in FIGS. 10, and 11. Optionally, other portable sources of electrical power may be utilized including rechargeable batteries, self-contained battery packs, or the like. Additionally, a power jack may be provided on the hub assembly 20*l* thereby enabling power to the motor by a typical AC wall adapter. Nevertheless, electrical power to the motor 45 is controlled by a switch 62 that is mounted on the hub assembly 12*l* and thus easily accessible by an adult user, wherein the switch is preferably a multi-position switch which will allow multiple speeds of operation. Moreover, the speed of operation of the swing drive assembly may be accomplished through conventional resistance elements which are selectively configured in a series connection with the motor, and battery circuit via the switch 62. Optionally, the switch may be configured to control the speed of operation through circuitry which intermittently delivers electrical power to the motor, the function and design of which is well known in the art.

Figure 13:
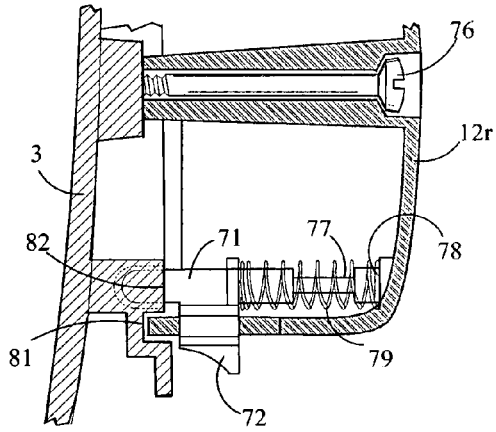
FIG. 13 is a partial cut-away view taken at 13—13 of FIG. 6 showing the arrangement of the components of the right side release button.

Release buttons (70*l* and 70*r*) are provided on both left and right (12*l* and 12*r*) hub assemblies in order to allow the handle assembly to be locked in a plurality of user selectable angular orientations with respect to the carrier shell 3 via hub seats (80*l* and 80*r*). The function and design of the left 70*l* and right 70*r* release buttons in addition to the left 80*l* and right 80*r* hub seats are substantially similar so only the right 70*r* release button and 80*r* hub seat will be described. As shown in FIGS. 9 and 13, release button 70*r* generally comprises a pin member 71 which is integrally attached to a thumb-access member 72. Member 72 has grooves 73 integrally formed on either side thereof for slidable insertion into a slot 74 formed in the walls of the hub assembly 12*r*. The pin member 71 also has a concentrically formed hole for slidable receipt of a rod 77 therein. The rod 77 projects outwardly from the cavity of the hub assembly 12*r* and is affixedly attached to a spring seat 78 which is in turn, affixed to the inner surface thereof as best shown in FIG. 13. The spring seat 78 is integrally formed thereon for incorporation of a spring 79 which biases the release button 70*r* outwardly away from the cavity of the hub assembly 12*r*.

Hub seats (80*l* and 80*r*) are integrally formed on either side of the carrier shell 3 to provide for rotational attachment of the handle assembly thereto and are secured in place via bolts 76. The right hub seat 80*r* has an annular depression 81 formed therein to accept the outer end of the hub assembly 12*r* and a circular plate member 82 which is encompassed thereby. When the hub assembly is installed onto the hub seat 80*r*, the force of the spring 79 causes the head of the rod 71 to press against the plate member 82. Holes (84*a*, 84*b*, and 84*c*) are formed in member 82 and are dimensioned to receive the head of the rod 71 therein, thereby providing a means to lock the handle assembly in a predetermined angular orientation. Thus, the handle assembly may be freely rotated by a user when the rods 71 are not positioned over any of the holes (84*a*, 84*b*, and 84*c*). However, when the handle assembly is rotated to a point where the rods 71 are over either of the holes, the force of the spring 79 presses the rods 71 thereinto and thus causing the handle assembly's angular orientation to become locked with respect to the carrier shell. Further rotation of the handle assembly requires the user to press outwardly on the release buttons (70*l* and 70*r*) while simultaneously rotating the handle assembly in order to disengage the rods 71 from the hole. Utilizing the aforedescribed configuration, the handle assembly may have virtually any quantity of predetermined locking angular orientations, limited only by the number of holes which can be formed in the circular plate 82. The present embodiment however, employs three sets of holes; hole 84*a* locks the handle assembly in the transport position, hole 84*b* locks the handle assembly in the access position, and hole 84*c* locks the handle assembly in the seat-forward position. Projections 85 which are integrally formed on the surface of the circular plate 82 act as a blocking mechanism to the head of the rod 71 thus insuring that the handle assembly is not rotated significantly beyond the transport or seat-forward positions.

The U-shaped member, hub assemblies (12*l* and 12*r*), bearings 23, battery compartment 60, rod 77, and spring seat 78 are preferably integrally formed from one piece of high strength thermoplastic, preferably a plastic material which will withstand a reasonable amount of normal as well as abnormal use without warpage or breakage thereby providing optimal safety for the infant contained within the carrier device. Those skilled in the art will recognize that there are several plastic formulations which are suitable for this purpose.

To use the swinging mechanism of the present invention, the handle assembly is initially placed in the transport position and the legs 26 moved to the extended position. The device is then placed on any generally level support surface such as a floor, a lawn, or the like and the switch adjusted to the desired speed setting for the swing drive mechanism. It is important to note that the length of either of the four legs may be easily adjusted at any time during the use thereof in order to compensate for any contour irregularities of the support surface. Following use, the aforementioned procedure is reversed and the baby carrier may again be used in a similar manner to any conventional prior art type baby carrier.

The present invention may be embodied in other specific forms without departing from the spirit or scope of the invention. For example, the aforedescribed embodiment discloses a pair of leg assemblies that are adapted to recede into the handle assembly while in the retracted position, however it is well known in the art that leg assemblies that are adapted to merely lie juxtaposed to the handle assembly while in the retracted position would achieve a substantially similar purpose and thus provide a substantially similar utility. Thus, the described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

I claim:

1. An improved baby carrier having an integral swinging mechanism, said baby carrier including an upward facing generally concave-shaped carrier shell for the containment and transport of an infant disposed therein, and a generally rigid handle assembly which is selectively lockable in a plurality of predetermined angular orientations with respect to said carrier shell, said improved baby carrier comprising:

a swing support structure means which is adapted for suspension of said carrier shell above a support surface, said swing support structure means being pivotably connected to said handle assembly along a pivot axis thereby allowing said carrier shell to swing in a pendulum-like action, said swing support structure means being reciprocatively movable by a user from an extended position wherein said carrier shell is suspended above said support surface in a stable manner, to a retracted position wherein said swing support structure means is confined within the handle assembly; and, a self-propelled actuation means which is drivingly connected to said swing support structure means, wherein said actuation means is adapted to impart said pendulum-like rocking action to said carrier shell.

2. The improved baby carrier having an integral swinging mechanism of claim 1, wherein said handle assembly further comprises a generally U-shaped member having a pair of generally vertically extending portions, each said vertically extending portion having an upper end and a depending end, the pivot axis of said swing support structure existing proximate the upper end of each said vertically extending portion.

3. The improved baby carrier having an integral swinging mechanism of claim 2, wherein each of the vertically extending portions of said handle assembly further comprises an elongated through hole, wherein said through hole is of predetermined size in order to accept said swing support structure therein, whereby said swing support structure means is essentially confined within the handle assembly of said baby carrier while in said retracted position.

4. The improved baby carrier having an integral swinging mechanism of claim 3, wherein said swing support structure means further characterized by a pair of leg assemblies, wherein each of said leg assembly is pivotably attached via said pivot axis to each of said vertically extending portion, each of said leg assembly comprising:

a pair of extendable legs having an effective length which is selectively adjustable by said user, said extendable legs being selectively lockable in either said extended position wherein the effective length of said extendable legs are sufficient to support said carrier shell above said support surface, or said retracted position wherein the effective length of said extendable legs are sufficiently short to recede into the confines of said elongated through hole.

5. The improved baby carrier having an integral swinging mechanism of claim 4, wherein said vertically extending portion of said handle assembly further comprises leg retention means for selective retention of said extendable legs within said through hole while in the retracted position.

6. The improved baby carrier having an integral swinging mechanism of claim 4, wherein each said pair of extendable legs further comprises a cross-brace means in order to provide for additional structural stability said pair of extendable legs.

7. The improved baby carrier having an integral swinging mechanism of claim 1, wherein said self-propelled actuation means comprises:

a motor drive means;

a gear assembly having a post eccentrically attached thereto, said gear assembly coupling said motor drive means to;

a pushrod which is rotatably connected to said post, said pushrod translating the rotational motion of said gear assembly to the pendulum-like rocking action of;

a lever means having a shaft which is in torsional communication with said swing support structure means.

8. The improved baby carrier having an integral swinging mechanism of claim 7, wherein said motor drive means is an electric motor.

9. The improved baby carrier having an integral swinging mechanism of claim 7, wherein said lever means comprises a torque spring.

10. An improved baby carrier having an integral swinging mechanism, said baby carrier including a conventional carrier shell for the containment and transport of an infant disposed therein, and a generally rigid handle assembly which is selectively lockable in a plurality of predetermined angular orientations with respect to said carrier shell, said handle assembly comprising a pair of generally vertically extending portions, wherein each of said vertically extending portion having an upper end and a depending end, said depending end being rotatably attached to said carrier shell and said upper end being attached to a cross member, said improved baby carrier comprising:

a pair of leg assemblies, wherein each of said leg assembly is pivotably attached to each of said vertically extending portions along a pivot axis, each of said leg assembly comprising:

a pair of extendable legs having an effective length which is selectively adjustable by said user, said extendable legs being selectively lockable in either said extended position wherein the effective length of said extendable legs are sufficient to support said carrier shell above said support surface in a stable manner, or said retracted position wherein the effective length of said extendable legs are sufficiently short to lie at least adjacent to said vertically extending portions; and, a self-propelled actuation means which is drivingly connected to at least one of said leg assembly, wherein said actuation means is adapted to impart said pendulum-like rocking action to said carrier shell.

11. The improved baby carrier having an integral swinging mechanism of claim 10, wherein the pivot axis of said pair of leg assemblies exist proximate the upper end of each said vertically extending portion.

12. The improved baby carrier having an integral swinging mechanism of claim 10, wherein each of the vertically extending portions of said handle assembly further comprises an elongated through hole, wherein said through hole is of predetermined size in order to accept said pair of leg assemblies therein, whereby both of said leg assemblies are essentially confined within the handle assembly of said baby carrier while in said retracted position.

13. The improved baby carrier having an integral swinging mechanism of claim 10, wherein said self-propelled actuation means comprises:

a motor drive means;

a gear assembly having a post eccentrically attached thereto, said gear assembly coupling said motor drive means to;

a pushrod which is rotatably connected to said post, said pushrod translating the rotational motion of said gear assembly to the pendulum like rocking action of;

a lever means having a shaft which is in torsional communication with said swing support structure means.

14. The improved baby carrier having an integral swinging mechanism of claim 13, wherein said motor drive means is an electric motor.

15. The improved baby carrier having an integral swinging mechanism of claim 13, wherein said lever means comprises a torque spring.

16. An improved baby carrier having an integral swinging mechanism, said baby carrier including a conventional carrier shell for the containment and transport of an infant disposed therein, and a generally rigid handle assembly which is selectively lockable in a plurality of predetermined angular orientations with respect to said carrier shell, said handle assembly comprising a pair of generally vertically extending portions, wherein each of said vertically extending portion has an upper end and a depending end, said depending end being rotatably attached to said carrier shell and said upper end being attached to a cross member, said improved baby carrier comprising:

a swing support structure means which is adapted for suspension of said carrier shell above a support surface, said swing support structure means being pivotably connected to said handle assembly along a pivot axis thereby allowing said carrier shell to swing in a pendulum-like action, said swing support structure means being reciprocatively movable by a user from an extended position wherein said carrier shell is suspended above said support surface in a stable manner, to a retracted position wherein said swing support structure means lies at least essentially proximate said vertically extending portion; and, a self-propelled actuation means drivingly connected to said swing support structure means, said self-propelled actuation means including a pushrod which is drivingly connected to a motor drive means for translating the rototational motion of said motor drive to the pendulum-like rocking action of said swing support structure means via a lever means.

17. The improved baby carrier having an integral swinging mechanism of claim 16, wherein the pivot axis of said swing support structure means exists proximate the upper end of each said vertically extending portion.

18. The improved baby carrier having an integral swinging mechanism of claim 16, wherein said motor drive means is an electric motor.

19. The improved baby carrier having an integral swinging mechanism of claim 16, wherein said lever means comprises a torque spring.

* * * * *